US005558808A

United States Patent [19]

Smith et al.

[11] Patent Number: 5,558,808

[45] Date of Patent: Sep. 24, 1996

[54] COLORED TRANSMISSION FLUID

[75] Inventors: Michael J. Smith, Newtown, Pa.; Bharat Desai, Ringwood, N.J.

[73] Assignee: United Color Manufacturing, Inc., Newtown, Pa.

[21] Appl. No.: 474,891

[22] Filed: Jun. 7, 1995

[51] Int. Cl.[6] ..... C10M 133/12; C10M 129/20; C10M 129/16

[52] U.S. Cl. ..... 508/556; 252/77; 252/75

[58] Field of Search ..... 252/51.5 R, 51.5 A, 252/51, 50, 68, 73, 75, 77

[56] References Cited

U.S. PATENT DOCUMENTS

| | | | |
|---|---|---|---|
| Re. 16,937 | 4/1928 | Iserman et al. | 44/312 |
| 659,565 | 10/1900 | Bally | 552/233 |
| 2,100,392 | 11/1937 | Haddock et al. | 552/249 |
| 2,925,333 | 2/1960 | Thompson | 44/59 |
| 3,006,851 | 10/1961 | Loeffler | 252/51.5 R |
| 3,164,449 | 1/1965 | Buxbaum | 44/59 |
| 3,435,054 | 3/1969 | Kranz et al. | 44/59 X |
| 3,445,391 | 5/1969 | Braid et al. | 252/51.5 R |
| 3,450,636 | 6/1969 | Rausch | 252/75 |
| 3,476,500 | 11/1969 | Litke | 44/59 X |
| 3,597,254 | 8/1971 | Graser et al. | 44/59 X |
| 3,640,872 | 2/1972 | Wiley et al. | 252/75 |
| 3,770,640 | 11/1973 | Bartlett | 252/68 |
| 3,852,205 | 12/1974 | Kablaoui et al. | 252/77 X |
| 3,915,871 | 10/1975 | Bryer et al. | 252/74 X |
| 3,915,999 | 10/1975 | Graser | 260/372 |
| 4,170,564 | 10/1979 | Brendle | 252/68 |
| 4,303,407 | 12/1981 | Marangelli et al. | 260/378 X |
| 4,369,120 | 1/1983 | Stelz et al. | 252/68 |
| 4,436,641 | 3/1984 | Stelz et al. | 252/68 |
| 4,504,404 | 3/1985 | Schumacher et al. | 252/51 X |
| 4,758,366 | 7/1988 | Parekh | 252/68 |
| 5,149,453 | 9/1992 | Parekh | 252/68 |
| 5,273,670 | 12/1993 | Endres et al. | 252/49.6 |

FOREIGN PATENT DOCUMENTS

| | | |
|---|---|---|
| 468109 | 1/1992 | European Pat. Off. . |

*Primary Examiner*—Douglas J. McGinty
*Attorney, Agent, or Firm*—Howrey & Simon

[57] ABSTRACT

Automatic transmission fluid containing a red dye stable even in long-lived transmission fluids.

19 Claims, No Drawings

COLORED TRANSMISSION FLUID

BACKGROUND

Automatic transmission fluid is a composition based upon selected grades of petroleum hydrocarbon oils incorporating essential performance additives. Additives include, for instance, anticorrosion agents, antifoaming agents, viscosity improvers and a red dye. The latter is added to provide an immediately visible characteristic to distinguish the automatic transmission fluid from other oily fluids used in automotive systems including, for example, lubes, brake and power steering fluids. The nature and degree to which the additives are present in automatic transmission fluid is specified by the automotive manufacturers notably the Dextron® series of specification issued by General Motors Corporation and the Mercon® specifications issued by the Ford Motor Company, specifications which have also been widely adopted by other automotive manufacturers. In all of these specifications, where a red dye is called for, the dye used is either the dry powder dye identified generically in the "Colour Index," a joint publication of the American Association of Textile Chemists and Colorists and the Society of Dyers and Colourists (UK), as C.I. Solvent Red 24 or its tinctorially equivalent analogue C.I. Solvent Red 164. The disclosure of this publication is incorporated herein by reference. The latter dye is supplied as a liquid dye concentrate and is now generally preferred over C.I. Solvent Red 24 because of its greater convenience of handling. Both C.I. Solvent Red 24 and 164 belong to the chemical class of azo dyes.

After the conventional passenger automobile fitted with an automatic transmission has been driven for about 40,000 miles, the transmission fluid becomes degraded chemically. During this period the dye additive also degrades and the originally bright pink or red transmission fluid turns initially to an orange shade, and ultimately to a dark brown color. This loss of red color is then often used as a visual indication that the fluid needs to be replaced which incurs expense and possible environmental hazards if the spent fluid is not disposed of properly. Prolonged use of degraded automatic transmission fluid, beyond its manufacturers recommended lifespan, considerably accelerates wear and damage to the automotive transmission system.

More recently, the manufacturers of ATF have made products with a considerably extended usable lifespan, i.e., 100,000 miles or even 200,000 miles or more in standard passenger vehicles. When these improved fluids are colored with C.I. Solvent Red 24 or C.I. Solvent Red 164, however, the dyes continue to degrade at essentially the same rate in the more stabile fluids as they did in the older grades of ATF. This may cause some to believe that the extended life characteristics of the ATF have been misrepresented because, in the automotive servicing industry, "everybody knows" that when ATF changes from red to brownish-orange, it is life-expired, notwithstanding the manufacturers' claims to the contrary. Consequently, the use of a red dye with a persistence commensurate to the extended life of the ATF has become very desirable.

SUMMARY OF THE INVENTION

The present invention provides a colored automatic transmission fluid, a liquid dye concentrate soluble in transmission fluid and methods of coloring transmission fluid with a long-lived red colorant.

DETAILED DESCRIPTION OF INVENTION

The coloration of automotive transmission fluid, particularly automatic transmission fluid, in high stability red shades can be achieved by use of certain N-substituted derivatives of 1,5 diaminoanthraquinone, either alone or in mixed compositions containing up to 50% of the analogous derivatives of 1,8 diaminoanthraquinone. The compounds of the invention can be symbolized as:

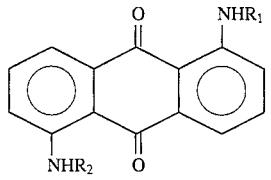

I

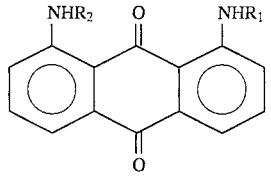

II where $R_1$ and $R_2$ are the same or different alkyl or substituted alkyl groups, a cycloalkyl group containing at least 3 carbons of 2 alkylphenyl or 2 alkyloxyphenyl group. The alkyl, cycloalkyl and substituted alkyl groups contain at least 2 carbons each. The alkyl groups preferably contain 2–12 carbons and the substituted alkyl groups contain up to 12 atoms. In addition, alkylarylamino-anthraquionone compounds of the following formulas may be used separately or as mixtures:

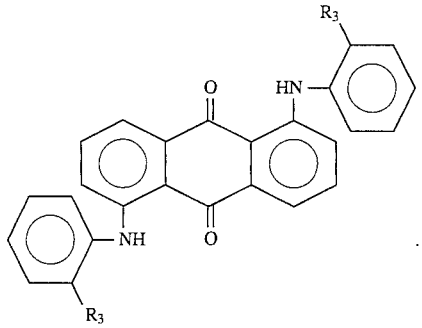

III

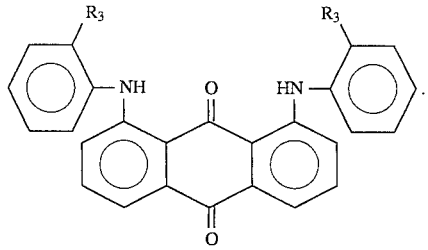

IV where $R_3$ is an alkyl or alkoxy group containing at least 2 carbons, preferably 2–12 carbons.

The general method of synthesis of the preferred compounds of this invention is well known to those skilled in the art. It involves the reaction of 1,5 or 1,5/1,8 mixtures of dihalageno, especially dichloro, or dinitro anthraquinones with aliphatic, 2 alkyl or 2 alkoxy anilines; optionally in the presence of an acid binding agent. For instance, U.S. Pat. No. 659,565, the disclosure of which is incorporated herein in its entirety by reference, indicates that especially 1,5 and 1,8 di p-tolylamino anthraquinones, or mixtures thereof, can be synthesized according to the general principles already recited using p-toluidine as the amine reagent. A general method for making 1,5 and 1,8 dinitro-anthraquinones is summarized below:

To 2500 kg 25% oleum is added 260 kg anthraquinone in 3–5 hours at 30° C. and 1050 kg mixed acid (28% nitric acid) run in. The temperature slowly raises to 50°–55° C. and the charge is then heated to 100° C. and maintained there for 10 hours. It is then cooled to 25° C. and filtered in an iron press. The cake is taken up with 400 liters of water, filtered, washed and dried. The expected yield is 380 kg.

Another reference whose teachings can be used by one of ordinary skill to make dyes of the present invention is FIAT 1313, Vol. II at page 20, the disclosure of which is incorporated herein by reference.

A patent which is useful in making a liquid concentrate form of dyes of the present invention is U.S. Pat. No. 3,597,254, the disclosure of which is incorporated herein by reference. Columns 3–4 (mixture No. 11) and Column 7 (mixture No. 6), of U.S. Pat. No. 3,596,254 disclose particularly useful amine mixtures for this purpose. The concentrate will be made by forming or placing the dye in a suitable carrier that is readily soluble in automatic transmission fluid, such as xylene. The dye preferably comprises 20–60% by weight of the concentrate. The concentrate of the present invention is preferably freeze-stable upon prolonged storage. That is, it does not crystallize to a commercially unacceptable degree after prolonged storage at 0° C. For instance, commercially undesirable crystallization will not occur after one month of storage at 0° C.

The compound 1,5 di p-tolylamino anthraquinone is a commercially available product identified generically in the "Colour Index" as C.I. Solvent Violet 14. Although this product has good heat stability in automatic transmission fluid, it is unacceptable for use since it is undeniably a violet and not a red dye. Red dye derivatives of 1,5/1,8 diaminoanthraquinone can only be achieved when the N-substituents of the molecule defined above are incorporated.

Methods of making arylanthraquionones are also well known. Methods suitable for use in conjunction with the present invention are set forth in U.S. Pat. No. 2,100,392, the disclosure of which is incorporated herein by reference.

Transmission fluids useful in the present invention include conventional fluids that are commercially available and long-lived transmission fluids that may last 100,000 miles, 200,000 miles or even more under normal passenger vehicle use. Although use of long-lived automatic transmission fluids are preferred, dyes of the present invention may also be used in more conventional automatic transmission fluids with normal useful life of about 50,000 miles under ordinary passenger vehicle use. When used with conventional fluids having an expected useful life of about 50,000 miles, the color intensity of the red dye will persist sufficiently to identify the transmission system as the source of a leak of petroleum fluid from that part of the vehicles system even when the fluid is near the end of its useful life. When used in long-lived fluids, those having an expected useful life of 75,000 miles, 100,000 miles, 200,000 miles or even more, the color intensity of the dye persists sufficiently through the life of the fluid to impart a visible red color to the composition. With use of this invention, therefore, instances of unnecessary disposal of long-lived transmission fluid merely because of color changes can be minimized or avoided.

Automatic transmission fluids, both conventional and long-lived fluids, are lubricating oils with additives incorporated to make the oil useful as an automatic transmission fluid. These additives are ordinarily specified by the vehicle manufacturer as previously noted. Formulators of transmission fluid are familiar with the additives required to provide automatic transmission fluid and can readily provide acceptable fluids.

The following examples serve to illustrate, but do not limit, the scope of the invention.

EXAMPLE 1

A 500 mL reaction flask is charged with 14 grams of 1,5 dichloroanthraquinone, 30 grams of xylene, 10 grams of anhydrous sodium acetate and 25 grams of cyclohexylamine. The mixture is heated to reflux and maintained overnight with condensate returned past a Dean and Stark trap. A thin layer chromatography (TLC) analysis is utilized to determine whether the formation of 1,5 dicyclohexylamino anthraquinone is complete. After the reaction is complete, the flask contents are cooled to 80° C. and 200 mL of methanol is added. The flask contents are cooled to 20° C. The product is separated in a good crystalline form; vacuum filtered; and then sequentially washed with methanol, 50% aqueous methanol, and water to remove any inorganic salts. The product is oven dried at 80° C. The dye is sparingly soluble in uncolored automatic transmission fluid to produce a crimson red coloration.

EXAMPLE 2

A 500 mL heated, stirred reaction flask is charged with 14 grams of 1,5 dichloroanthaquinone, 60 grams of xylene, 10 grams of sodium acetate and 45 grams of (2' ethylhexyloxy) propylamine. The mixture is heated to reflux and held overnight. After the reaction is complete, the flask contents are cooled to 90° C. A solution of 30 grams of acetic acid in 200 mLs of a 10% aqueous sodium chloride solution is added. The mixture is raised to reflux, held for 15 minutes, then cooled to 85° C. and transferred to a separatory funnel. A lower aqueous phase containing the unreacted amines, dissolved as their acetate salts, is run off. The upper organic phase containing the dye is then replaced in the flask and stripped under vacuum to 180° C. to remove all volatile material. The experiment yields 153 grams of red oil which is set to a waxy solid at ambient temperatures. It is readily soluble in uncolored automatic transmission fluid and produces a crimson red coloration.

EXAMPLE 3

The procedure of example 2 is followed, except the 415 grams of 3(2'ethylhexyloxy) propylamine is replaced by a mixture of 11 grams of 2 ethylhexylamine, 8 grams of methoxypropylamine and 15 grams of 3(2'ethylhexyloxy) propylamine. When the condensation is complete, the reaction mixture is again extracted with a saline acetic acid mixture and the dye phase is returned to the flask. After distilling any entrapped water, xylene is then added to bring the weight of nonvolatiles and xylene to 215 grams and this mixture is then filtered. The product is a stable homogenous liquid instantly miscible with uncolored automatic transmission fluid and produces a crimson red shade. The xylene-based liquid concentrate of the dye remains very fluid, and has complete resistance to crystallization even after prolonged storage at 0° Fahrenheit.

EXAMPLE 4

30 grams of a mixture of 1,15 and 1,8 dinitroanthraquinones prepared by the method disclosed in FIAT 1313, Volume II, page 220 is charged in a stirred 500 mL reaction flask. 85 grams of a high-boiling alkylnaphthalene solvent is then added, followed by 16 grams of methoxypropylamine, 22 grams of 2 ethylhexylamine and 30 grams of 3(2'ethylhexoxy) propylamine. The mixture is heated to boiling and the water of reaction is distilled. A TLC is performed to evaluate the completion of reaction. When the test demonstrates that the reaction is complete, the system is distilled to 180° C. under vacuum to remove all volatile material. The contents of the flask are then adjusted to 280 grams with alkylated naphthalene solvent. The product forms a fluid composition with good cold storage stability and a flash point in excess of 200° F. Addition of the product to uncolored automatic transmission fluid causes it to become a bluer shade of red than the compound of Example 3.

EXAMPLE 5

137 grams of o-phenetidine, 15 grams of anhydrous sodium acetate, and 13.5 grams of anhydrous sodium carbonate is charged to a stirred 500 mL reaction flask. The mixture is heated to reflux to distill out traces of water. 20 grams of 1,5 dichloroanthraquinone is added and the mixture is cooled to 120° C. The mixture is then raised to reflux (195° C.) and held overnight. The next morning the reaction is cooled to 70° C. 90 mL of methanol is added while cooling the mixture to 25 ° C. The product is filtered and washed with cold methanol. The filtercake is then reslurried with 600 mL of a 10% aqueous solution of hydrochloric acid to dissolve any entrained, unreacted o-phenetidine. The product is again filtered, washed with water, and dried. About 29 grams of product is obtained. The dye is readily soluble in uncolored automatic transmission fluid, imparting a bluish red shade with a wavelength of maximum absorbance of 540.5 nanometers.

EXAMPLE 6

A 0.2% solution of the Unisol Liquid Red B brand of C.I. Solvent Red 164 in high stability automatic transmission fluid was prepared together with equivalent solutions of several of the dyes prepared in the preceding examples. These solutions were placed in stirred reaction flasks and heated to 190° C. as an accelerated test of their stability. The transmission fluid manufacturers' test is usually terminated after 24 hours. As the following table shows, tests indicate that the color stability of compositions of the present invention is materially greater than a conventional composition containing C.I. Solvent Red 164.

The heated solutions were sampled at intervals and the intensity of dye measured using heated uncolored transmission fluid as a control reference. Results are as follows:

| | Color Intensity as a Measure of Percentage of Original Dye Remaining After Exposure at 190° C. | | | |
|---|---|---|---|---|
| Red Dye Tested | 6 hours | 24 hours | 36 hours | 48 hours |
| C.I. Solvent Red 164 | 86 | 65 | 50 | 26 |
| Example 1 | 100 | 100 | 100 | 100 |
| Example 3 | 100 | 99 | 98 | 86 |
| Example 4 | 100 | 92 | 86 | 80 |
| Example 5 | 100 | 100 | 100 | 98 |

From the above table it will be observed that all the dyes of the current invention, examples 1, 3, 4, and 5, are all much more resistant to degradation in heated automatic transmission fluid than is the prior art colorant C.I. Solvent Red 164. In general, compositions of the present invention will maintain about 80–100% of their color intensity upon heating for about 48 hours in accordance with Example 6 and about 90–100% of their color intensity after heating for about 24 hours in accordance with Example 6.

What is claimed is:

1. A composition comprising automatic transmission fluid and at least one of the following dyes:

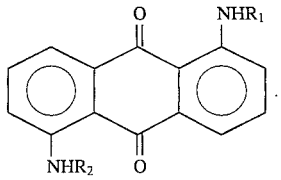

I

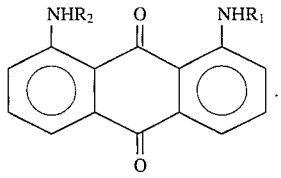

II wherein $R_1$ and $R_2$ are the same or different alkyl groups containing at least 2 carbons each or a cycloalkyl group containing at least 3 carbons, and said dye is present in an amount sufficient to impart visible red color to said fluid.

2. A composition comprising automatic transmission fluid and at least one of the following dyes:

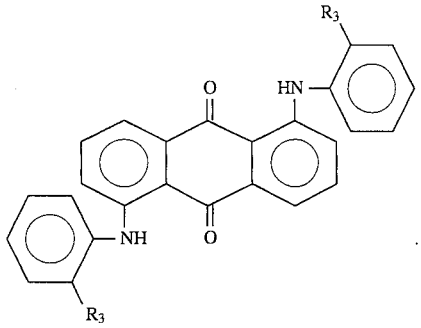

III

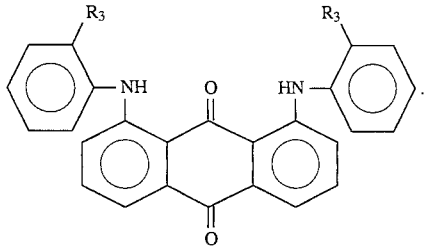

IV wherein $R_3$ is an alkyl or alkoxy group containing at least 2 carbons and said dye is present in amounts sufficient to impart visible red color to said fluid.

3. A composition comprising automatic transmission fluid and at least two of the following dyes:

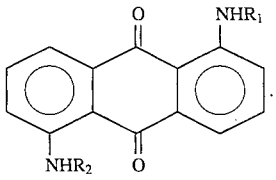

I

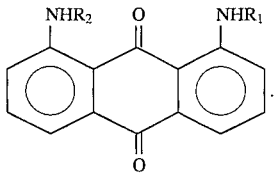

II

-continued

III

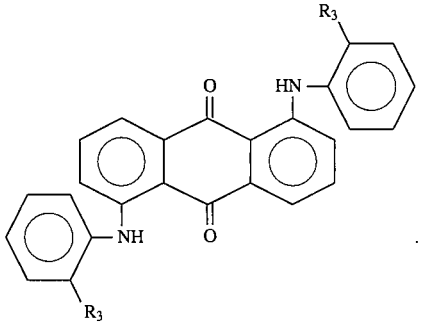

IV

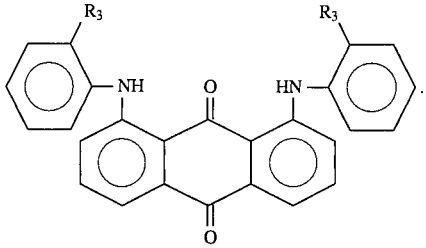

wherein $R_1$ and $R_2$ are the same or different alkyl groups containing at least 2 carbons each or a cycloalkyl group containing at least 3 carbons, $R_3$ is an alkyl or alkoxy group containing at least 2 carbons, and said dye is present in an amount sufficient to impart visible red color to said fluid.

4. A composition as recited in claim 3 wherein said dye comprises a mixture of formulas I and II.

5. A composition as recited in claim 3 wherein said dye comprises a mixture of formulas III and IV.

6. A composition as recited in claim 1 wherein said transmission fluid contains about 0.05 to 5.0 percent of said dye.

7. A composition according to claim 1 where $R_1$ and $R_2$ are both cyclohexyl.

8. A composition according to claim 1 where $R_1$ and $R_2$ are a mixture of methoxypropyl, 2'ethyhexyl and 2'ethylhexoxy groups.

9. A composition according to claim 2 where $R_3$ is a 1 methylethyl group.

10. A composition according to claim 2 where $R_3$ is an ethoxy group.

11. A composition as recited in claim 7 wherein said transmission fluid contains about 0.01 to 1.0 percent of said dye.

12. A composition as recited in claim 4 wherein said transmission fluid contains about 0.05 to 5.0 percent of said dye.

13. A composition as recited in claim 9 wherein said transmission fluid contains about 0.05 to 1.0 percent of said dye.

14. A composition as recited in claim 10 wherein said transmission fluid contains about 0.05 to 1.0 percent of said dye.

15. A method of coloring automatic transmission fluid comprising obtaining an automatic transmission fluid, adding at least one of the following dyes to said fluid in an amount sufficient to visibly color said fluid red:

I

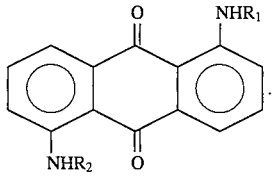

II

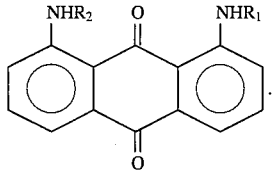

III

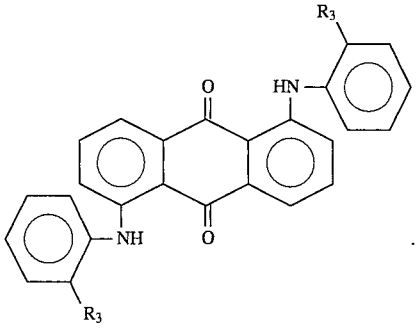

IV

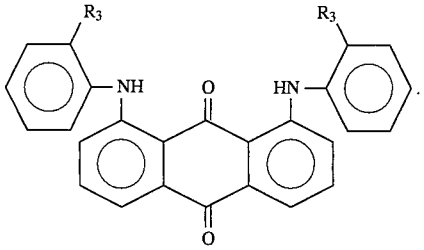

and dissolving said dye into said fluid.

16. A composition comprising automatic transmission fluid and at least one of the following dyes:

I

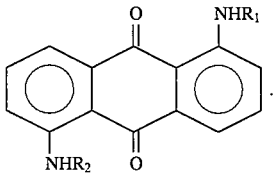

-continued

II

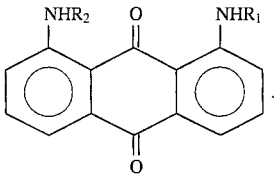

wherein $R_1$ and $R_2$ are the same or different alkyl groups containing at least 2 carbons each or a cycloalkyl group containing at least 3 carbons, said dye is present in an amount sufficient to impart visible red color to said fluid, and said visible red color persists through the life of said fluid.

17. A composition as recited in claim 16 wherein said composition maintains about 80% or more of its color intensity after heating for about 48 hours at 190° C.

18. A composition as recited in claim 16 wherein said composition maintains about 92% or more of its color intensity after heating for about 24 hours at 190° C.

19. A composition as recited in claim 2 wherein said transmission fluid contains about 0.05 to 5.0 percent of said dye.

* * * * *